US007265666B2

(12) United States Patent
Daniel

(10) Patent No.: US 7,265,666 B2
(45) Date of Patent: Sep. 4, 2007

(54) FOOTWEAR COVERT ALARM AND LOCATOR APPARATUS

(76) Inventor: Sayo Isaac Daniel, 70 Oceana Dr. West, suite 5E, Brooklyn, NY (US) 11235

( * ) Notice: Subject to any disclaimer, the term of this patent is extended or adjusted under 35 U.S.C. 154(b) by 204 days.

(21) Appl. No.: 10/979,894

(22) Filed: Nov. 1, 2004

(65) Prior Publication Data

US 2006/0103538 A1 May 18, 2006

(51) Int. Cl.
*G08B 1/08* (2006.01)

(52) U.S. Cl. ..... 340/539.11; 340/539.1; 340/539.13; 340/573.1; 340/825.36; 340/825.49; 342/357.07; 342/357.09; 701/213

(58) Field of Classification Search ..... 340/539.1, 340/539.11, 539.13, 521, 531, 571, 573.1, 340/573.3, 825.36, 825.49; 701/213; 342/357.1, 342/357.07, 357.09
See application file for complete search history.

(56) References Cited

U.S. PATENT DOCUMENTS

| | | | | |
|---|---|---|---|---|
| 1,658,848 | A | 2/1928 | Kalikow | |
| 1,771,258 | A | 7/1930 | Kalikow et al. | |
| 3,777,086 | A | 12/1973 | Riedo | |
| 4,350,853 | A | 9/1982 | Ganyard | |
| 4,598,272 | A | 7/1986 | Cox | |
| 5,557,259 | A | 9/1996 | Musa | |
| 5,574,432 | A | 11/1996 | McCarthy | |
| 5,748,087 | A | 5/1998 | Ingargiola et al. | |
| 5,905,461 | A | 5/1999 | Neher | |
| 5,914,659 | A | 6/1999 | Herman et al. | |
| 6,278,370 | B1 | 8/2001 | Underwood | |
| 6,362,778 | B2 | 3/2002 | Neher | |
| 6,388,612 | B1 | 5/2002 | Neher | |
| 6,396,403 | B1 * | 5/2002 | Haner | 340/573.4 |
| 6,788,200 | B1 * | 9/2004 | Jamel et al. | 340/539.13 |
| 6,812,840 | B2 * | 11/2004 | Gehlot et al. | 340/572.1 |
| 6,867,697 | B2 * | 3/2005 | Nanayakkara et al. | 340/573.1 |

FOREIGN PATENT DOCUMENTS

| | | |
|---|---|---|
| GB | 2119142 | 11/1983 |
| GB | 2352551 | 1/2001 |

* cited by examiner

*Primary Examiner*—Hung Nguyen
(74) *Attorney, Agent, or Firm*—Sanford J. Asman

(57) ABSTRACT

An alarm apparatus for footwear wherein the footwear includes a sole and a boot connected to the sole thereof. An alarm circuit for generating an alarm signal is positioned within and concealed by the sole of the footwear. An activation switch is positioned on an exterior surface of the boot and is electrically connected to the alarm circuit. Means for transmitting the alarm signal is connected to the alarm circuit. Upon activation of the alarm switch, the alarm signal is generated by the alarm circuit and transmitted by the transmitting means for receipt at a remote location thereby notifying a remote user that a local user is in distress.

15 Claims, 7 Drawing Sheets

FOOTWEAR COVERT ALARM AND LOCATOR APPARATUS

BACKGROUND OF THE INVENTION

1. Field of the Invention

The present invention relates generally to footwear and, more specifically, to footwear having an alarm circuit that can be selectively engaged by the user to transmit a coded signal to a monitoring authority. The alarm circuit is comprised of circuit board, battery, processor, switch and wiring. The alarm circuit further includes a global positioning system (GPS) for sending location data to the monitoring authority. The alarm circuit is selectively operable via a covered switch for preventing false alarms. The cover can serve as camouflage rendering switch location variable and covert.

2. Description of the Prior Art

There are other alarm device designed for articles. Typical of these is U.S. Pat. No. 1,658,848 issued to Kalikow on Feb. 14, 1928.

Another patent was issued to Kalikow et al on Jul. 22, 1930 as U.S. Pat. No. 1,771,258. Yet another U.S. Pat. No. 3,777,086 was issued to Riedo on Dec. 4, 1973 and still yet another was issued on Sep. 21, 1982 to Ganyard as U.S. Pat. No. 4,350,853.

Another patent was issued to Cox on Jul. 1, 1986 as U.S. Pat. No. 4,598,272. Yet another U.S. Pat. No. 5,557,259 was issued to Musa on Sep. 17, 1996. Another was issued to McCarthy on Nov. 12, 1996 as U.S. Pat. No. 5,574,432 and still yet another was issued on May 5, 1998 to Ingargiola et al. as U.S. Pat. No. 5,748,087.

Another patent was issued to Neher on May 18, 1999 as U.S. Pat. No. 5,905,461. Yet another U.S. Pat. No. 5,914,659 was issued to Herman et al. on U.S. Pat. No. 5,914,659. Another was issued to Underwood on Aug. 21, 2001 as U.S. Pat. No. 6,278,370 and still yet another was issued on Mar. 26, 2002 to Neher as U.S. Pat. No. 6,362,778.

Another patent was issued to Neher on May 14, 2002 as U.S. Pat. No. 6,388,612. Another was issued to Morrison on Nov. 9, 1983 as U.S. Patent No. GB2119142 and still yet another was issued on Jan. 31, 2001 to Guzman as U.K. Patent No. GB2352551.

While these devices may be suitable for the purposes for which they were designed, they would not be as suitable for the purposes of the present invention, as hereinafter described.

U.S. Pat. No. 1,658,848

Inventor: Samuel M. Kalikow

Issued: Feb. 14, 1928

A combined hold up and burglar alarm for stores and, the like comprising in combination a floor mat composed of at least five superimposed members, the upper middle and lowermost of said members being of sheet metal, the other two of said members being of insulating material, the lowermost of the latter two having cut out portions therein, at least the three uppermost members being flexible, the two uppermost members being readily penetrable, a source of current, an alarm device, a lock operated switch, a hold up circuit including said source, alarm device and the two uppermost metal members, a burglar alarm circuit U.S. Pat. No. 1,771,258

Inventor: Samuel M. Kalikow et al

Issued: Jul. 22, 1930

In a shoe circuit maker of the class described, a heel with an edge arranged to be readily compressible relative to the other portions of the heel, and a contact maker with a pointed end mounted within the heel and in the vicinity of the said edge so as to remain within the heel upon one's standing on the heel in. a normal way, and extendible relative to the heel upon inclination of the heel on said edge and application of one's standing force to compress the said edge.

U.S. Pat. No. 3,777,086

Inventor: Otto Riedo

Issued: Dec. 4, 1973

The invention provides equipment for use on the human body, for giving signal, especially in alarm systems, comprising a vehicle for attachment to a limb of the human body, and an actuating instrument incorporated in said vehicle and adapted to respond to movements of said vehicle such that a change of position of said limb and of said vehicle affects the actuating instrument to give an alarm.

U.S. Pat. No. 4,350,853

Inventor: Floyd P. Ganyard

Issued: Sep. 21, 1982

An alarm toe switch inserted within a shoe for energizing an alarm circuit n a covert manner includes an insole mounting pad into which a miniature reed switch is fixedly molded. An elongated slot perpendicular to the reed switch is formed in the bottom surface of the mounting pad. A permanent cylindrical magnet positioned in the forward portion of the slot with a diameter greater than the pad thickness causes a bump above the pad. A foam rubber block is also positioned in the slot rearwardly of the magnet and holds the magnet in normal inoperative relation. A non-magnetic support plate covers the slot and holds the magnet and foam rubber in the slot. The plate minimizes bending and frictional forces to improve movement of the magnet for reliable switch activation. The bump occupies the knuckle space beneath the big toe. When the big toe is scrunched rearwardly the magnet is moved within the slot relative to the reed switch, thus magnetically activating the switch. When toe pressure is released the foam rubber block forces the magnet back into normal inoperative position to deactivate the reed switch. The reed switch is hermetically sealed with the magnet acting through the wall so the switch assembly S is capable of reliable operation even in wet and corrosive environments.

U.S. Pat. No. 4,598,272

Inventor: Randall P. Cox

Issued: Jul. 1, 1986

The apparatus not only enables the monitoring person to monitor the whereabouts of the monitored person, pet or article, but also to locate the latter if he, she or it becomes separated from the monitoring person. It also enables the monitoring person to interrupt an abductor, to draw attention to him, to frighten or confuse him, and hopefully, to cause him to release the monitored person, pet or article.

U.S. Pat. No. 5,557,259

Inventor: John S. Musa

Issued: Sep. 17, 1996

A proximity alert and direction indicator is provided that allows an observer to monitor the proximity of a subject under surveillance, particularly a child. The subject wears a transmitter removeably attached to the shoe. The observer wears a receiver-containing bracelet. The receiver contains a proximity detector with threshold set that emits an audible sound when the distance between the subject and the observer exceeds some preset distance. The receiver also contains a direction finder with graphic display that shows the observer the direction to the subject.

U.S. Pat. No. 5,574,432

Inventor: Steven R. McCarthy

Issued: Nov. 12, 1996

An apparatus attachable to a shoe for deploying a rescue signal includes a base attachable to a rear section of a conventional shoe. The base comprises strips coupled to a lower extent thereof and extended horizontally therefrom. The strips each have a plurality of buttons coupled thereto. The base also comprises a slot formed on a top surface thereof. Also included is a restraining unit adapted to secure about an upper extent of the shoe. The restraining unit comprises an annular band adapted to slidably insert within the slot of the base. The restraining unit further includes a pair of generally triangular members attached to the band and extended downwardly therefrom. The triangular members each have a plurality of buttonholes coupleable to the buttons disposed on the strips of the base. A metal rod is adapted to insert within a lateral bore formed in a heel of the shoe and further within a pair of apertures formed in the strips. Finally, a signalling mechanism situated within the base deploys a rescue signal upon the manual activation thereof or upon the failure to respond to an alarm adapted to indicate the cessation of a predetermined amount of time.

U.S. Pat. No. 5,748,087

Inventor: Thomas R. Ingargiola

Issued: May 5, 1998

A remote monitoring system, particularly useful in monitoring the position of a child or Alzheimer's patient, has a first unit including a handheld portable transmitter and receiver; and a second unit including two identical sections, wherein each section is carried in one of a footwear pair, and each section has a transmitter and receiver. The transmitter of the first unit has a selective switch for on-demand transmission of a find signal. The transmitters of the second unit each continuously emit a location signal. The receiver of the first or handheld unit is responsive to one of or both location signals. The handheld unit generates an audible alarm indicating that the person wearing the footwear has gone beyond a preset distance from the first or handheld unit. The receivers of the second unit each receive the find signal generated by the first unit, and in response thereto, actuates a plurality of illuminating devices, such as LEDs in the soles of the footwear as well as actuating an audio alarm from the footwear.

U.S. Pat. No. 5,905,461

Inventor: Timothy J. Neher

Issued: May 18, 1999

A global positioning and tracking system for locating one of a person and item of property. The global positioning and tracking system comprises at least one tracking device for connection to the one of the person and item of property including a processing device for determining a location of the tracking device and generating a position signal and a transmitter for transmitting said position signal. The position signal is transmitted to a relay station strategically positioned about a desired monitoring area. The relay station includes a device for receiving the positional signal and determining if the received position signal is a valid signal and a device for relaying the position signal upon determining the position signal is valid to a central monitoring station. The central monitoring station receives the validated positional signal from the relay station and analyzes the position signal for monitoring the position of the tracking device. The system may also include a tracking satellite for receiving the validated position signal from the relay station and re-transmitting the position signal to the central monitoring station when the central monitoring station is located outside the transmission range of the relay station.

U.S. Pat. No. 5,914,659

Inventor: Edie Herman et al.

Issued: Jun. 22, 1999

A shoe size fit sensor indicates by a perceptible alarm that the shoe of an infant, a toddler or other small child is too tight for wear. The shoe fit sensor sets off a perceptible visual and or audible alarm when a child's toe makes constant with the sensor when the shoe is too tight. To avoid false alarms when the child kicks with the shoe, a time delay is provided so that incidental touching of the sensor by momentary kicks does not set off the constant alarm. The sensor also determines when a sock is "bunched up" in the toe area, and distinguishes this condition from a condition where constant contact by a portion of the child's foot indicates that the shoe is too tight.

U.S. Pat. No. 6,278,370

Inventor: Lowel Underwood

Issued: Aug. 21, 2001

A child locating and tracking apparatus which provides for the location of a child that is lost, abducted or in general danger to be quickly located is disclosed. The apparatus uses a small transmitter that is always carried by the child and as such, is always present when danger arises. The transmitter is easily disguised and hidden in the child's clothing or personal adornments such as shoes, coats, watches, earrings, bracelets, rings and the like. The apparatus uses a system of world wide receivers such as those provided by local cellular telephone towers or by low earth orbiting satellites used for low power communication. When a child is lost or in danger, the child simply activates the transmitter which sends a signal to a central reporting station or stations where trained personnel will contact the respective parents and/or care givers to determine if the child could possibly be in danger. If an affirmative decision is reached, the monitoring station personnel will then assist the local law enforcement officials in the respective area anywhere in the world where the alarm was received in locating the child and removing the child from harm's path.

U.S. Pat. No. 6,362,778

Inventor: Timothy J. Neher

Issued: Mar. 26, 2002

A personal locator system for determining the location of a locator unit. The system includes a locator device in communication with both a central station and a GPS satellite. The locator unit includes a portable housing able to be worn about the wrist of a user. A communication system is positioned within the housing for contacting the central station and includes a transmitter and receiver. A GPS unit is also positioned within the housing for contacting the GPS system for determining a location of said locator device. Upon receipt of a location request signal by the receiver from the central station, the locator unit activates the GPS unit to contact the GPS system and receive location data therefrom. Upon receipt of the location data, the transmitter transmits the location data to the central station for analysis. A panic button is provided for transmitting an emergency signal to the central station and initiating detecting the location of the locator unit. A non-emergency call button is provided for transmitting a location request signal to the central station and in response thereto, informing a person on the contact list as to the location of the locator device. The communication system utilizes one of a POTS, cellular, PCS or internet communications network. A tamper detection sensor detects when said device is tampered with. A beacon generator generates an ultrasonic or radio frequency beacon signal for aiding a person in pinpointing a location of the device.

U.S. Pat. No. 6,388,612

Inventor: Timothy J. Neher

Issued: May 14, 2002

A global positioning and tracking system for locating objects including a plurality of tracking devices each releasably secured to an object and a central monitoring station. Each tracking device includes a processing device for storing an identification code unique to the tracking device, determining a location of the tracking device and generating a position signal based upon the determined location, a cellular transmitter/receiver for receiving and initiating cellular transmissions. The central monitoring station receives a location request and identification code from a user and initiates a cellular transmission including the identification code to a telephone number assigned to the tracking units. Upon receipt of the cellular transmission each tracking unit compares the identification code with its stored identification code. The tracking unit with a stored identification code determined to match the received identification code generates and transmits a position signal to the central monitoring station via cellular transmission channels. The central monitoring station then relays the position signal to the user. The user is able to provide a location request to the central monitoring station by at least one of a telephone communication and an electronic message via an Internet connection. Each tracking device is also able to generate a distress signal for transmission to the central monitoring unit upon detection of an emergency situation or automatically upon breaking of the circuit of the tracking unit.

U.K. Patent Number GB2119142

Inventor: John Malcolm Morrison

Issued: Nov. 9, 1983

Inactivity alarm apparatus for monitoring the well-being of a subject individual comprises a transmitting station carried in the shoe of the subject arranged to transmit a burst of r.f. radiation upon each step taken by the subject and a remote receiving station (FIG. 2) to receive the transmitted bursts which each reset an interval timer (28). If inactivity persists for, say, a 2 minute interval without a resetting transmission an alarm (36) is sounded. The apparatus differs from similar inactivity alarm apparatus in that the transmitting station includes an electrical generator in the form of a piezoelectric element which is struck a percussive blow each time pressure is placed on the shoe and the electrical pulse generated is applied by way of spark gap element to a tuned circuit embedded in the heel of the shoe which radiates a burst of decaying oscillations for resetting the interval timer. The use of a self contained generator simplifies the construction and obviates the disadvantages associated with battery operated systems of remembering to switch the apparatus on and off and checking the charge status of the batteries to avoid false alarms.

U.K. Patent Number GB2352551

Inventor: John Malcolm Morrison

Issued: Mar. 26, 2002

An entertaining/protective sound generating system for use with footwear, such as sneakers includes a receiver/alarm circuit located within the sole of at least one sneaker, and a remote hand-held controller. The receiver/alarm circuit in the shoes further includes, a speaker, a speaker driver, an LED array an LED diver circuit, a motion detector, a memory with sound files and a processor for controlling its operation. According to a first embodiment, the user presses a button on the controller, transmitting a signal to the sneakers. The signal will be interpreted by the processor as a request to select a sound file (corresponding to the particular depressed button) from the memory and send it to be amplified and subsequently played by the speaker. The LED's may flash along with the playing of the sound file. In a second embodiment, another button of the controller is activated which puts the receiver in an "alarm mode," wherein the processor awaits receipt of a sneaker-movement or proximity signal from the motion sensor prior to sending a predetermined alarm sound data file to be played by the speaker. In a third mode, a sound file is played for a brief period whenever the motion detector produces a signal.

SUMMARY OF THE PRESENT INVENTION

The present invention relates generally to footwear and, more specifically, to footwear having an alarm circuit that can be selectively engaged by the user to transmit a coded signal to a monitoring authority. The alarm circuit is comprised of circuit board, battery, processor, switch and wiring. The alarm circuit further includes a global positioning system (GPS) for sending location data to the monitoring authority. The alarm circuit is selectively operable via a covered switch for preventing false alarms. The cover can serve as camouflage rendering switch location variable and covert.

A primary object of the present invention is to provide an alarm circuit for footwear that overcomes the shortcomings of the prior art Another object of the present invention is to provide an alarm circuit for footwear for selectively determining a user's location.

Yet another object of the present invention is to provide an alarm circuit for footwear which can be activated by the user.

Still yet another object of the present invention is to provide an alarm circuit for footwear wherein the activation switch is positioned on the exterior wall thereof.

Yet another object of the present invention is to provide an alarm circuit including a switch cover for cover the activation switch.

A further object of the present invention is to provide an alarm circuit wherein the switch cover prevents the alarm circuit from being inadvertently activated.

Another object of the present invention is to provide an alarm circuit wherein the switch cover is formed from a semi-rigid material.

Still another object of the present invention is to provide an alarm circuit for footwear wherein the activation switch cover serves as camouflage, rendering the switch location variable and covert.

Still yet another object of the present invention is to provide an alarm circuit includes a circuit board, battery, processor, activation switch and wiring.

Another object of the present invention is to provide an alarm circuit for footwear wherein the said circuit board, battery and processor are positioned within the sole of the footwear.

Another object of the present invention is to provide an alarm circuit for footwear wherein the said wiring is concealed in the boot of the footwear.

Another object of the present invention is to provide an alarm circuit wherein the circuit includes a GPS transponder.

Yet another object of the present invention is to provide an alarm circuit for footwear wherein the GPS transponder is linked to a satellite system.

Still another object of the present invention is to provide an alarm for footwear circuit wherein the satellite system relays an alarm signal to a GPS monitoring center.

Another object of the present invention is to provide an alarm for footwear circuit wherein said GPS monitoring center visually monitors the individual's location on a computer screen.

Still a further object of the present invention is to provide an alarm for footwear wherein the monitoring center is able to selectively monitor the movement or activity of a user Yet a further object of the present invention is to provide an alarm for footwear wherein the monitoring center is able to selectively notify an emergency or rescue unit.

An even further object of the present invention is to provide an alarm for footwear wherein the footwear is at least one of a men's shoe and a women's shoe.

Still another object of the present invention is to provide an alarm for footwear wherein the footwear is at least one of a sneaker, a casual shoe, a loafer and a dress shoe.

Additional objects of the present invention will appear as the description proceeds.

The present invention overcomes the shortcomings of the prior art by providing footwear having an alarm circuit that can be selectively activated by the user to transmit a predetermined alarm signal to a monitoring authority. The alarm circuit is comprised of circuit board, battery, processor, activation switch and wiring. The present invention provides for an additional element in the form of GPS location determination receiver that can be used to send location data to a monitoring unit. Inclusion of a switch cover prevents accidental activations. It an also serves as camouflage, rendering the switch location variable and covert. The switch cover can be hinged like a flap using hook and loop material to maintain a closed and inconspicuous means of access. The cover can also incorporate some rigidity or structure to prevent activation of the switch by pressing on the cover.

The foregoing and other objects and advantages will appear from the description to follow. In the description, references are made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 6 is an illustrative view of the switch cover and wiring harness of the footwear alarm of the present invention; and.

LIST OF REFERENCE NUMERALS

Figure 1:
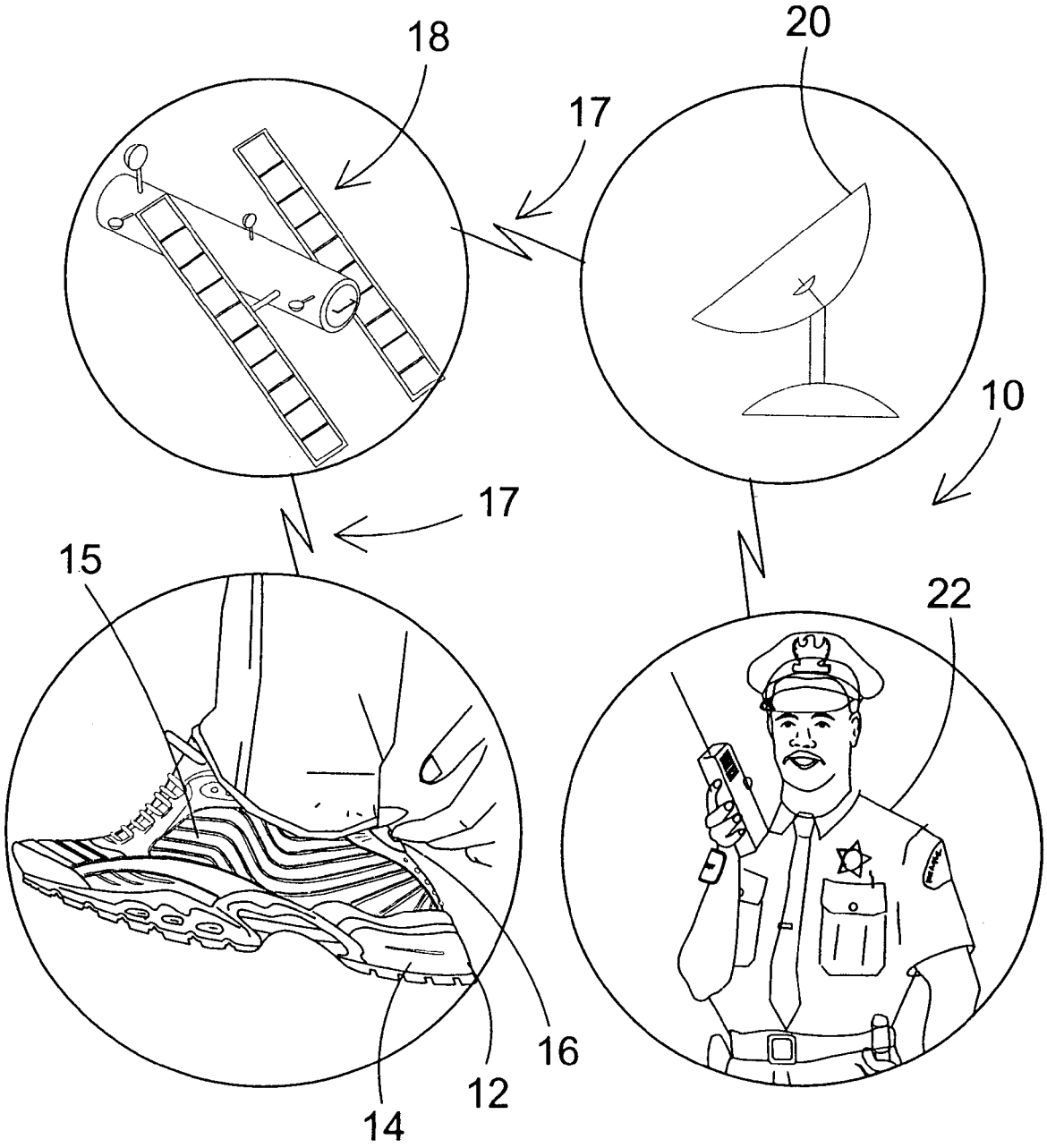
FIG. 1 is an illustrative view of the footwear alarm and locator apparatus of the present invention.

Turning now descriptively to the drawings, in which similar reference characters denote similar elements throughout the several views, the Figures illustrate the ladder including storage areas of the present invention. With regard to the reference numerals used, the following numbering is used throughout the various drawing figures.

10 footwear alarm of the present invention
12 footwear
14 sole
15 boot
16 user
17 alarm signal
18 communication device
20 monitoring authority
21 notification
22 responding unit
24 switch
26 switch cover
28 hinge
30 alarm circuitry
32 circuit board
34 power source
36 processor
38 wiring harness
40 wires
42 global positioning system

DETAILED DESCRIPTION OF THE PREFERRED EMBODIMENT

The following discussion describes in detail one embodiment of the footwear alarm and locator apparatus (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 7 illustrate the footwear alarm of the present invention indicated generally by the numeral 10.

Figure 3:
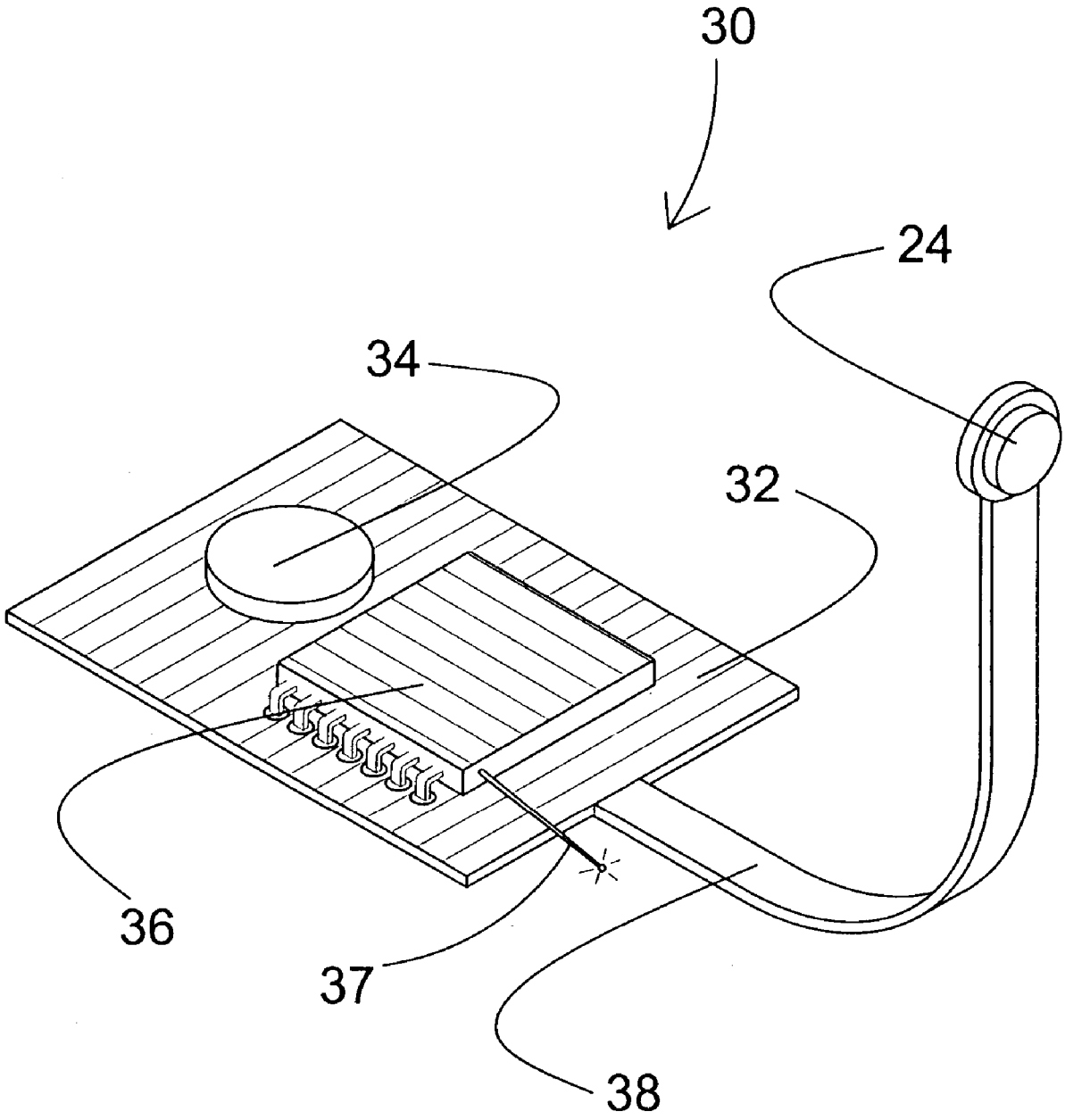
FIG. 3 is an illustrative view of the GPS transponder of the footwear alarm of the present invention.

FIG. 1 is an illustrative view of the footwear alarm and locator apparatus of the present invention. The present invention is a personal location protection system for providing a global positioning system in an article of footwear that is designed to protect the wearer. The footwear alarm system 10 includes an article of footwear 12. As shown herein, the footwear 12 is a sneaker. However, footwear 12 may be any type and style of mens and/or women's footwear. Generally, the footwear 12 includes a sole 14 and a boot 15 for receiving a user's foot therein. The boot 15 is connected to a top side of the sole 14. An alarm circuit 30 as shown in FIG. 3, is contained and concealed within the sole 14 of the footwear 12. The footwear alarm 10 o the present invention further includes a communication system 18 for receiving at least an alarm signal 17 emitted by the alarm circuit 30 of the footwear alarm 10. A monitoring authority 20 is able to monitor any alarm signals 17 received by the communication system 18. Upon detection of the at least one alarm system 17, the monitoring authority 20 notifies a responder 22 to assist the user in distress. As shown herein, the responder is a police officer but the responder can be any public or private service required to assist a user in distress.

Upon the alarm circuit 30 being activated, the alarm signal 17 is emitted thereby. The signal is received by a communication system 18, which is preferably a satellite system. The communication system 18 receives the alarm signal 17 and re-transmits the alarm signal 17 to the monitoring authority 20. The monitoring authority is established to wearer of the footwear alarm 10 once the alarm circuit 30 has been activated. The monitoring authority 20 is able to visually monitor the individual's location, movement or any activity on the ground and can notify the responder 22 which may include an emergency or rescue unit.

Figure 2:
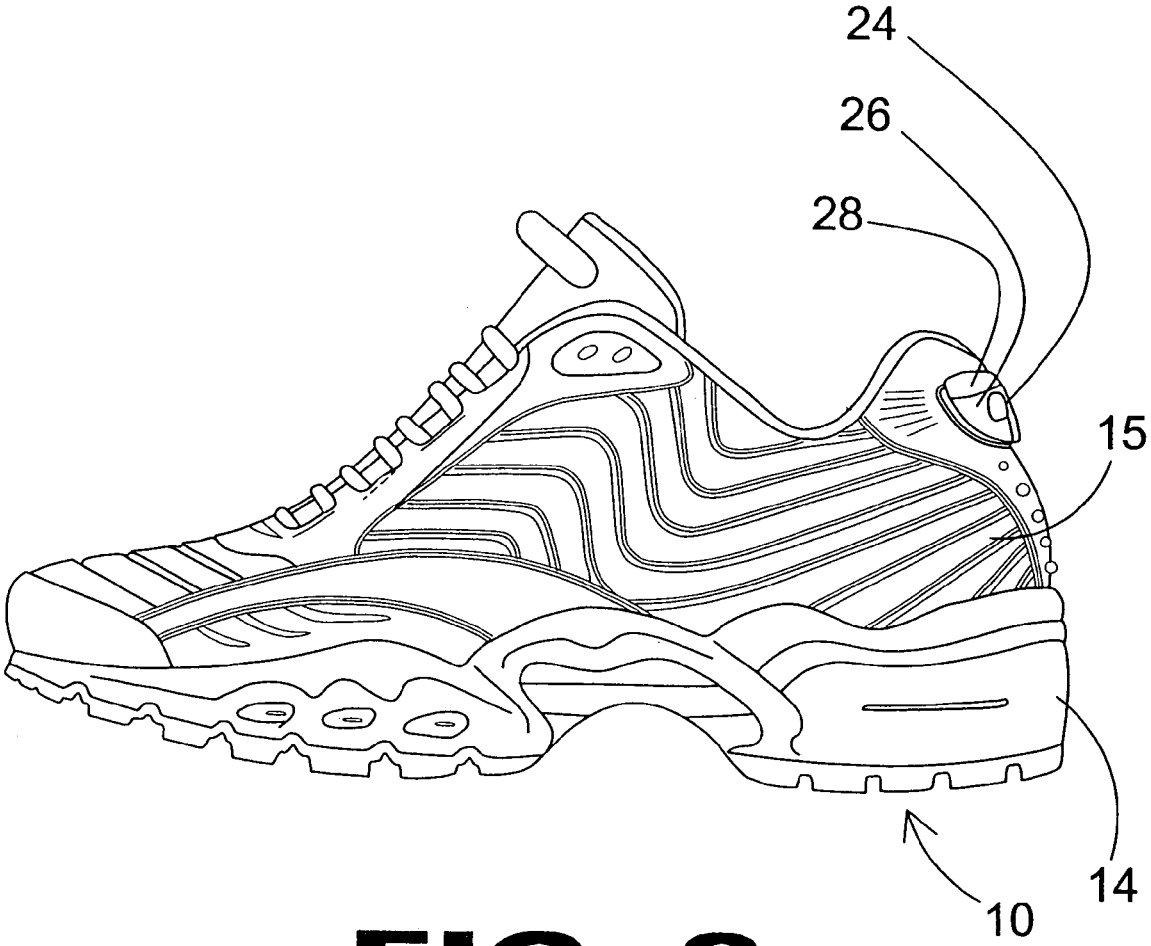
FIG. 2 is a side view of footwear equipped with the footwear alarm of the present invention.

FIG. 2 is a side view of footwear 12 equipped with the footwear alarm 10 of the present invention. The footwear 12 includes the boot 15 connected to the sole 14 thereof. The boot 15 is able to receive the foot of a user therein. Positioned within the sole 14 of the alarm circuit 30 which will be discussed in greater detail hereinafter with specific reference to FIG. 3.

The boot 15 includes a recess where the foot is received therethrough. and laces for tightening the recess around the ankle of the user. Positioned on an exterior surface of the boot 15 is the activation switch 24. The activation switch 24 can be selectively depressed to at least one of activate and deactivate the alarm circuit 30. The switch 24 is preferably covered by a switch cover 26 which is hingedly connected to the exterior side of the boot 15 by a hinge 28. Preferably, the cover is made of a material similar to the exterior surface of the boot 15 and is designed to match the color and pattern of the footwear 12 for the purpose of concealing the switch 24. Additionally, it is preferred that the switch cover 26 is semi-rigid in order to prevent accidental activation of the alarm circuit 30 and the GPS transponder. As shown in FIG. 2, the switch is positioned at the heel of the footwear 12. This is shown for purposes of example only and the switch 24 may be positioned along any portion of the exterior surface of the boot 15 of the footwear 12.

FIG. 3 is an illustrative view of the alarm circuit 30 of the footwear alarm 10 of the present invention. The alarm circuit is comprised of a circuit board 32, having a power source 34 and processor 36 positioned thereon. Conventional wires connect the circuit board 32 with the switch 24. The wires are contained in a wiring harness 38. Preferably, the circuit board 32 is formed from silicon. The circuit board 32 is small enough to be concealed within the sole 14 of the footwear 12. An antenna 37 is connected to the processor 36 on the circuit board 32. Alternatively, the antenna may be incorporated within the wiring harness 38. The wiring harness 38 extends through the sole 14 and partially through the boot 15 of the footwear 12 in order to connect the switch 24 to the circuit board 32.

Upon activation of the switch 24, the processor 36 causes an alarm signal 17 to be generated and transmitted via the antenna 37. The processor 36 includes the GPS transponder for communication with a GPS satellite as is shown in FIG. 1. The communication system 18 receives the alarm signal 17 and re-transmits the alarm signal 17 to the monitoring authority 20. The monitoring authority is established to wearer of the footwear alarm 10 once the alarm circuit 30 has been activated. The monitoring authority 20 is able to visually monitor the individual's location, movement or any activity on the ground and can notify the responder 22 which may include an emergency or rescue unit.

Figure 4:
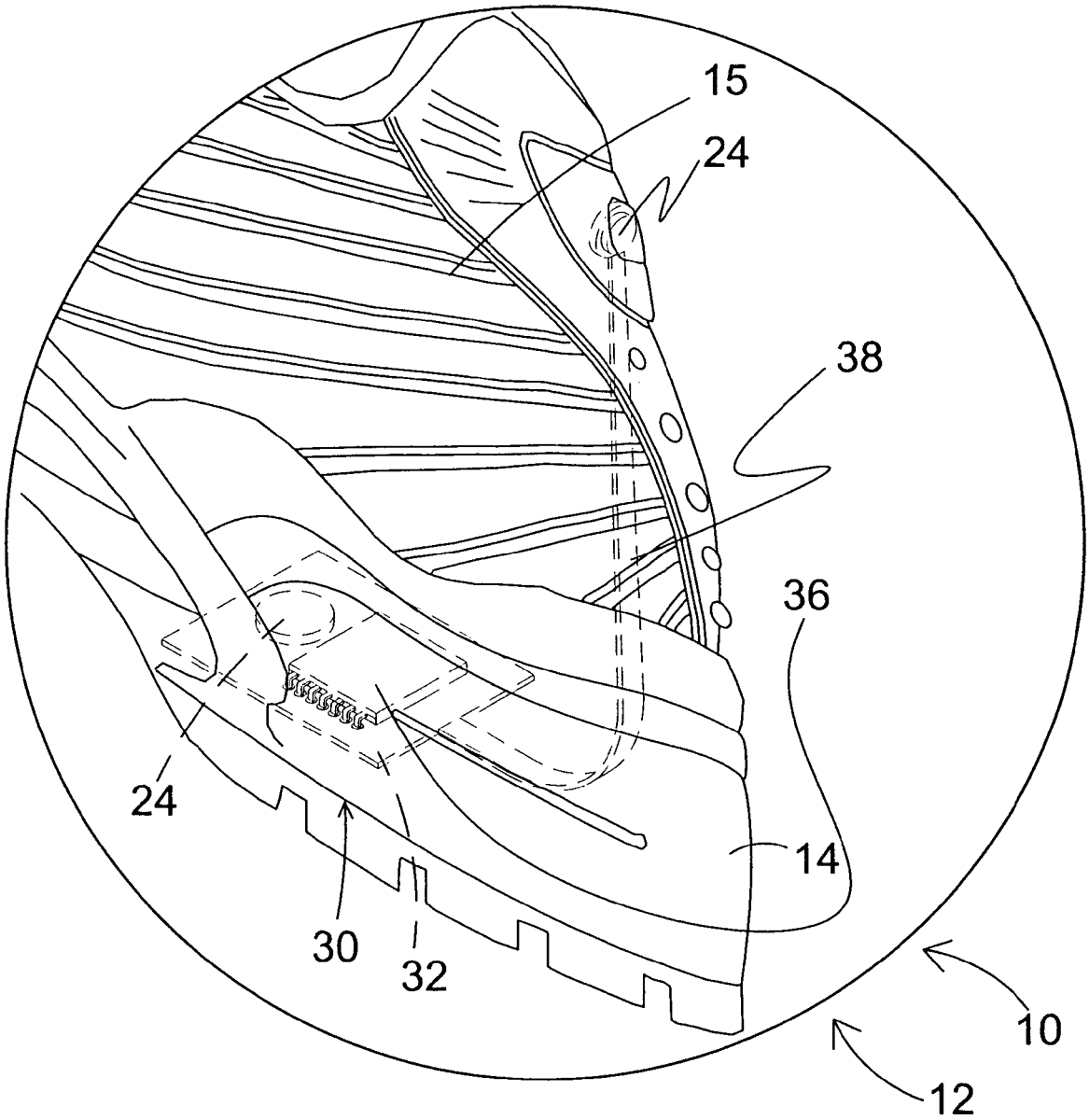
FIG. 4 is a partial cut-away view of the footwear having the footwear alarm of the present invention contained therein.

FIG. 4 is a partial cut-away view of the footwear having the footwear alarm of the present invention contained therein. The alarm circuit is comprised of a circuit board 32, having a power source 34 and processor 36 positioned thereon. Conventional wires connect the circuit board 32 with the switch 24. The wires are contained in a wiring harness 38. Preferably, the circuit board 32 is formed from silicon. The circuit board 32 is small enough to be concealed within the sole 14 of the footwear 12. An antenna 37 is connected to the processor 36 on the circuit board 32. Alternatively, the antenna may be incorporated within the wiring harness 38. The wiring harness 38 extends through the sole 14 and partially through the boot 15 of the footwear 12 in order to connect the switch 24 to the circuit board 32.

Upon activation of the switch 24, the processor 36 causes an alarm signal 17 to be generated and transmitted via the antenna 37. The processor 36 includes the GPS transponder for communication with a GPS satellite as is shown in FIG. 1. The communication system 18 receives the alarm signal 17 and re-transmits the alarm signal 17 to the monitoring authority 20. The monitoring authority is established to wearer of the footwear alarm 10 once the alarm circuit 30 has been activated. The monitoring authority 20 is able to visually monitor the individual's location, movement or any activity on the ground and can notify the responder 22 which may include an emergency or rescue unit.

Figure 5:
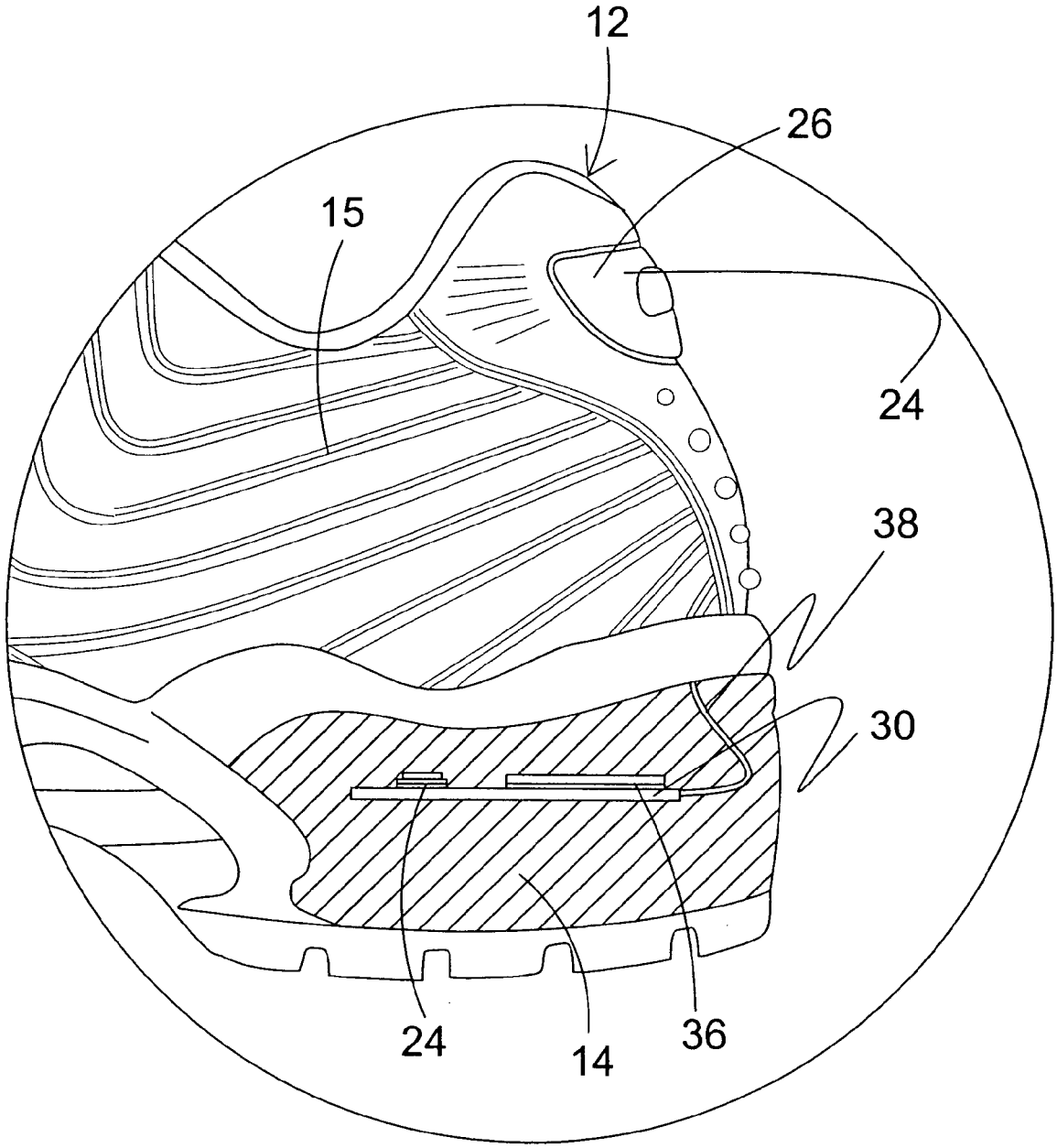
FIG. 5 is a side partial cut-away view of the footwear having the footwear alarm of the present invention contained therein.

FIG. 5 is a side partial cut-away view of the footwear having the footwear alarm of the present invention contained therein. The alarm circuit is comprised of a circuit board 32, having a power source 34 and processor 36 positioned thereon. Conventional wires connect the circuit board 32 with the switch 24. The wires are contained in a wiring harness 38. Preferably, the circuit board 32 is formed from silicon. The circuit board 32 is small enough to be concealed within the sole 14 of the footwear 12. An antenna 37 is connected to the processor 36 on the circuit board 32. Alternatively, the antenna may be incorporated within the wiring harness 38. The wiring harness 38 extends through the sole 14 and partially through the boot 15 of the footwear 12 in order to connect the switch 24 to the circuit board 32.

Upon activation of the switch 24, the processor 36 causes an alarm signal 17 to be generated and transmitted via the antenna 37. The processor 36 includes the GPS transponder for communication with a GPS satellite as is shown in FIG. 1. The communication system 18 receives the alarm signal 17 and re-transmits the alarm signal 17 to the monitoring authority 20. The monitoring authority is established to wearer of the footwear alarm 10 once the alarm circuit 30 has been activated. The monitoring authority 20 is able to visually monitor the individual's location, movement or any activity on the ground and can notify the responder 22 which may include an emergency or rescue unit.

As shown herein, the alarm circuit 30 is concealed within the sole 14 of the footwear 12. Furthermore, in addition to concealing the alarm circuit 30, the sole 14 of the footwear acts as a protective barrier for the circuit board 32. The sole 14 is preferably formed to absorb any shock normally associated with at least one of walking and running thereby allowing the alarm circuit 30 to function as designed.

Figure 6:
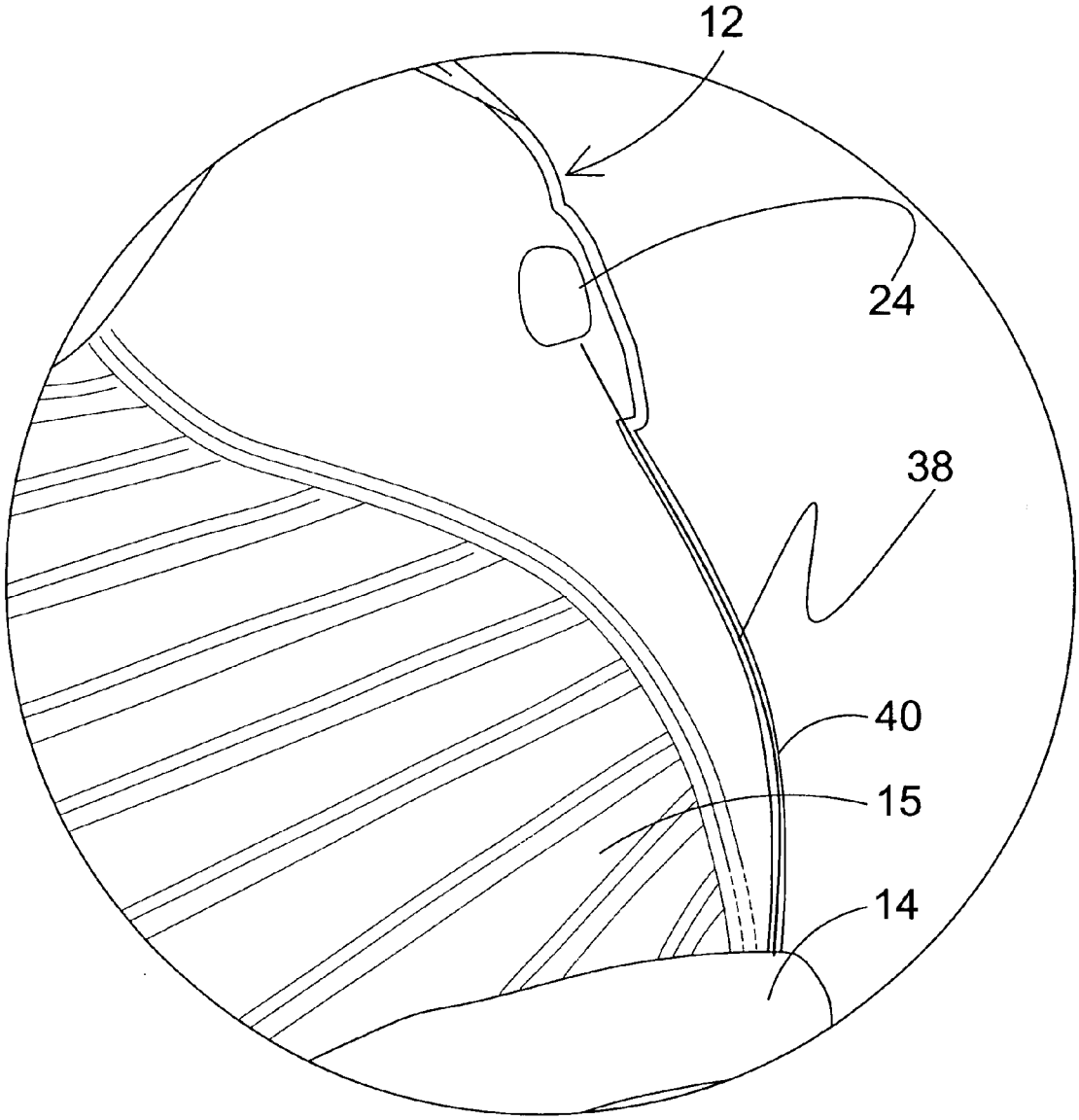

FIG. 6 is an illustrative view of the switch cover and wiring harness of the footwear alarm of the present invention. The footwear 12 includes the boot 15 connected to the sole 14 thereof. The boot 15 is able to receive the foot of a user therein. Positioned within the sole 14 of the alarm circuit 30 which will be discussed in greater detail hereinafter with specific reference to FIG. 3.

The boot 15 includes a recess where the foot is received therethrough. and laces for tightening the recess around the ankle of the user. Positioned on an exterior surface of the boot 15 is the activation switch 24. The activation switch 24 can be selectively depressed to at least one of activate and deactivate the alarm circuit 30. The switch 24 is preferably covered by a switch cover 26 which is hingedly connected to the exterior side of the boot 15 by a hinge 28. Preferably, the cover is made of a material similar to the exterior surface of the boot 15 and is designed to match the color and pattern of the footwear 12 for the purpose of concealing the switch 24. Additionally, it is preferred that the switch cover 26 is semi-rigid in order to prevent accidental activation of the alarm circuit 30 and the GPS transponder. As shown in FIG. 2, the switch is positioned at the heel of the footwear 12. This is shown for purposes of example only and the switch 24 may be positioned along any portion of the exterior surface of the boot 15 of the footwear 12.

The alarm circuit is comprised of a circuit board 32, having a power source 34 and processor 36 positioned thereon. Conventional wires connect the circuit board 32 with the switch 24. The wires are contained in a wiring harness 38. Preferably, the circuit board 32 is formed from silicon. The circuit board 32 is small enough to be concealed within the sole 14 of the footwear 12. An antenna 37 is connected to the processor 36 on the circuit board 32. Alternatively, the antenna may be incorporated within the wiring harness 38. The wiring harness 38 extends through the sole 14 and partially through the boot 15 of the footwear 12 in order to connect the switch 24 to the circuit board 32.

Upon activation of the switch 24, the processor 36 causes an alarm signal 17 to be generated and transmitted via the antenna 37. The processor 36 includes the GPS transponder for communication with a GPS satellite as is shown in FIG. 1. The communication system 18 receives the alarm signal 17 and re-transmits the alarm signal 17 to the monitoring authority 20. The monitoring authority is established to wearer of the footwear alarm 10 once the alarm circuit 30 has been activated. The monitoring authority 20 is able to visually monitor the individual's location, movement or any activity on the ground and can notify the responder 22 which may include an emergency or rescue unit.

Figure 7:
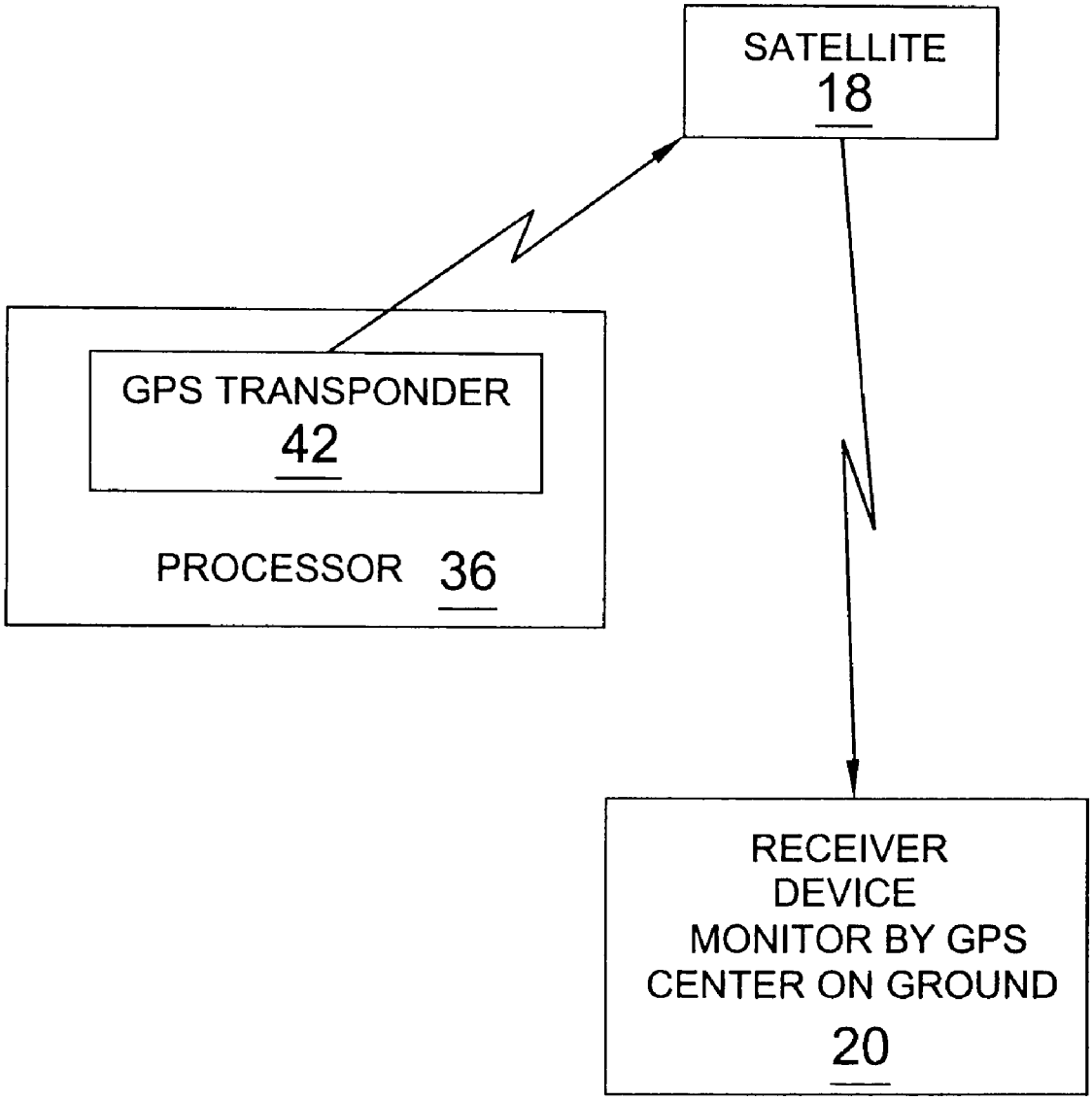
FIG. 7 is a block diagram of the footwear alarm of the present invention.

FIG. 7 is a block diagram of the footwear alarm of the present invention. The present invention is a personal location protection system for providing a global positioning system in an article of footwear that is designed to protect the wearer. The footwear alarm system 10 includes an article of footwear 12. As shown herein, the footwear 12 is a sneaker. However, footwear 12 may be any type and style of mens and/or women's footwear. Generally, the footwear 12 includes a sole 14 and a boot 15 for receiving a user's foot therein. The boot 15 is connected to a top side of the sole 14. An alarm circuit 30 as shown in FIG. 3, is contained and concealed within the sole 14 of the footwear 12. The footwear alarm 10 o the present invention further includes a communication system 18 for receiving at least an alarm signal 17 emitted by the alarm circuit 30 of the footwear alarm 10. A monitoring authority 20 is able to monitor any alarm signals 17 received by the communication system 18. Upon detection of the at least one alarm system 17, the monitoring authority 20 notifies a responder 22 to assist the user in distress. As shown herein, the responder is a police officer but the responder can be any public or private service required to assist a user in distress.

Upon the alarm circuit 30 being activated, the alarm signal 17 is emitted thereby. The signal is received by a communication system 18, which is preferably a satellite system. The communication system 18 receives the alarm signal 17 and re-transmits the alarm signal 17 to the monitoring authority 20. The monitoring authority is established to wearer of the footwear alarm 10 once the alarm circuit 30 has been activated. The monitoring authority 20 is able to visually monitor the individual's location, movement or any activity on the ground and can notify the responder 22 which may include an emergency or rescue unit.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An alarm apparatus comprising:

(a) an article of footwear comprising a sole and a boot connected to said sole;

(b) an alarm circuit for generating an alarm signal, said alarm circuit being positioned within, and concealed by, said sole of said footwear, said alarm circuit including means for determining the location of said alarm apparatus and means for encoding said location in said alarm signal;

(c) a covert activation switch for selective activation by the wearer of said footwear, said covert activation switch being positioned on an exterior surface of said boot and electrically connected to said alarm circuit, said covert activation switch being hidden from view; and (d) means for transmitting said alarm signal, said means for transmitting being connected to said alarm circuit, wherein upon activation of said covert activation switch, said alarm signal is generated by said alarm circuit and said alarm signal, including said encoded location, is transmitted by said transmitting means for receipt at a remote location thereby notifying a remote user that a local user is in distress and simultaneously notifying said remote user of the location of said alarm apparatus.

2. The alarm apparatus of claim 1, wherein said alarm circuit comprises a circuit board having a processor positioned thereon and connected to said transmitting means, wherein said processor generates said alarm signal and provides said generated alarm signal to said transmitting means for transmission thereof.

3. The alarm apparatus of claim 2, wherein said means for determining the location of said alarm apparatus and means for encoding said location in said alarm signal is comprised of a global positioning system receiver connected to said processor.

4. The alarm apparatus of claim 3, wherein said global positioning system receiver provides an output signal representative of the positional location of said local user to said processor and said generated alarm signal is encoded with said positional location.

5. The alarm apparatus of claim 4, further comprising a monitoring body for receiving said generated alarm signal having said positional location thereon and selectively notifying a responder that said local user is in distress and providing said responder with the location of said local user as encoded by said global positioning system.

6. The alarm apparatus of claim 5, wherein said monitoring body is able to visually monitor the positional location of said local user based on the receipt of said generated alarm signal having said positional location encoded thereon.

7. The alarm apparatus of claim 6, wherein said electrical connection between said covert activation switch and said alarm circuit is comprised of insulated copper wires.

8. The alarm apparatus of claim 7, further comprising a wiring harness for protecting said insulated copper wires.

9. The alarm apparatus of claim 8, wherein said wiring harness extends at least partially through said sole and said boot.

10. The alarm apparatus of claim 9, wherein said sole of said footwear protects said alarm circuit positioned therein.

11. The alarm apparatus of claim 10, wherein said sole is able to absorb shock associated with at least one of walking and running.

12. The alarm apparatus of claim 11, further comprising a cover hingedly connected to said boot for covering said covert activation switch.

13. The alarm apparatus of claim 12, wherein said cover is formed from a semi-rigid material for preventing inadvertent activation of said covert activation switch.

14. The alarm apparatus of claim 13, wherein said footwear is at least one of men's footwear and women's footwear.

15. The alarm apparatus of claim 14, wherein said footwear is at least one of a sneaker, a shoe, a boot, a pump, and a loafer.

* * * * *